US006371818B1

(12) United States Patent
Saito et al.

(10) Patent No.: US 6,371,818 B1
(45) Date of Patent: Apr. 16, 2002

(54) CONNECTOR

(75) Inventors: Masashi Saito; Takashi Koide; Masahiko Aoyama, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/568,269

(22) Filed: May 10, 2000

(30) Foreign Application Priority Data

May 11, 1999 (JP) ..... 11-130487

(51) Int. Cl.[7] ..... H01R 13/436
(52) U.S. Cl. ..... 439/752
(58) Field of Search ..... 439/752, 595

(56) References Cited

U.S. PATENT DOCUMENTS

| | | | | |
|---|---|---|---|---|
| 4,867,705 A | | 9/1989 | Yuasa | 439/595 |
| 4,946,399 A | | 8/1990 | Kawashima | 439/752 |
| 5,066,252 A | | 11/1991 | Kato et al. | 439/752 |
| 5,378,176 A | | 1/1995 | Sasai | 439/752 |
| 5,478,263 A | | 12/1995 | Kato | 439/752 |
| 5,651,704 A | | 7/1997 | Fukushima et al. | 439/752 |
| 5,653,613 A | | 8/1997 | Shimoda | 439/752 |
| 5,800,216 A | * | 9/1998 | Okada | 439/752 |
| 5,865,653 A | * | 2/1999 | Okada et al. | 439/752 |

* cited by examiner

*Primary Examiner*—Gary Paumen
(74) *Attorney, Agent, or Firm*—Anthony J. Casella; Gerald E. Hespos

(57) ABSTRACT

A connector is provided to enhance a force of a retainer for locking terminal fittings. The connector has a housing 1 formed with a retainer mount hole 12. A retainer 13 is provided for insertion into the retainer mount hole 12. Locking projections 15 are formed on the retainer 13 and are engaged with terminal fittings 16, to prevent the terminal fittings from coming out of the housing 1. End locking portions 19 are provided at the opposite ends of the retainer 13, and intermediate locking portions 20 are provided between the end locking portions 19. The female housing 1 is provided with end and intermediate receiving portions 21, 22 corresponding to the end and intermediate locking portions 19, 20. Partial and full locking portions 23, 24 for holding the retainer 13 in its partial and full locking positions are formed in the end and intermediate receiving portions 21, 22. If the retainer 13 has a long width, its force to lock the terminal fittings may be reduced at and near the center of the female housing 1. However, since the corresponding pairs of locking portions and receiving portions are provided in intermediate positions, a sufficient locking force can be ensured.

7 Claims, 8 Drawing Sheets

CONNECTOR

BACKGROUND OF THE INVENTION

1. Field of the Invention

The present invention relates to a connector provided with a retainer.

2. Description of the Related Art

Prior art electrical connectors have a connector housing for receiving at least one terminal fitting. Some prior art electrical connectors further include a retainer that can be inserted into the connector housing to prevent removal of the terminal fittings from the housing. A prior art connector with a retainer is disclosed in the Japanese Unexamined Patent Publication No. 6-151002. The housing of the connector shown in JP 6-151002 is formed with locking portions, which are brought elastically into engagement with the respective terminal fittings. The connector further includes a retainer that is formed with terminal locking portions for locking the respective terminal fittings. Thus a dual locking construction is provided to prevent the terminal fittings from coming out of the connector housing.

The connector housing disclosed in JP 6-151002 is formed with a plurality of locking projections that are disposed side by side on the outer surfaces of the left and right walls of the housing. The retainer, on the other hand, is formed with a pair of sidepieces on its opposite sides so that the housing can be held between the sidepieces. The sidepieces are formed with windows at locations that correspond to the respective locking projections. Thus, by selectively fitting the locking projections into the windows, the retainer can be held in a partial locking position (where the insertion and withdrawal of the terminal fittings are permitted) and in a full locking position (where the terminal locking portions are engaged with the terminal fittings to make the insertion and the withdrawal of the terminal fittings impossible).

The above described prior art connector, however, has a problem. In particular, the width of the connector increases as the number of contacts increases because a multitude of cavities must be arranged side by side. Then, a middle portion of the retainer is likely to warp due to an insufficient rigidity. As a result, terminal fittings inserted in a middle portion of the housing are locked with an insufficient force.

The present invention was developed to respond to such a problem, and an object of the invention is to provide a connector capable of locking terminal fittings with an enhanced force.

SUMMARY OF THE INVENTION

The subject invention is directed to a connector that comprises a housing with at least one cavity and at least one terminal fitting accommodated in the respective cavity. The connector further comprises a retainer that is mountable in a retainer mount hole of the housing. The retainer comprises at least one locking projection for locking a corresponding one of the terminal fittings so as that the terminal fitting will not come out of the housing after the terminal fitting has been inserted to a proper position in the respective cavity. At least one intermediate locking portion is provided in an intermediate position on the retainer, and at least one intermediate receiving portion is provided in a position on the housing that corresponds to the position of the intermediate locking portion.

According to the invention, the connector further comprises: end locking portions at the opposite ends of the retainer. End receiving portions are provided in the housing and can be engaged with the end locking portions when the retainer is inserted to its proper position in the retainer mount hole. Additionally, at least one intermediate locking portion is provided between the end locking portions.

Preferably, the retainer mount hole substantially communicates with the respective cavities and is open in one side surface of the housing.

According to a further embodiment, a connector comprises a housing having a plurality of cavities formed side by side and a plurality of terminal fittings accommodated respectively in the cavities. The housing also comprises a retainer mount hole which is open in one side surface of the housing and which communicates with the respective cavities. The housing further comprises locking projections for locking the corresponding terminal fittings so as not to come out when the terminal fittings are inserted to their proper positions in the cavities. The connector also comprises a retainer that can be inserted into the retainer mount hole. End locking portions are provided at the opposite ends of the retainer, and end-receiving portions are provided in the housing. The end-receiving portions are configured for engagement with the end locking portions when the retainer is inserted to its proper position in the retainer mount hole. At least one intermediate locking portion is provided in a position on the retainer between the end locking portions, and at least one intermediate receiving portion is provided in a position on the housing that corresponds to the position of the intermediate locking portion.

Accordingly, the retainer is mounted into the retainer mount hole after the terminal fittings are inserted to their proper insertion positions in the respective cavities of the housing. The end locking portions that are located at the opposite ends of the retainer and the intermediate locking portions that are located between the end locking portions then are engaged with the end and intermediate receiving portions of the housing. Thus, the respective terminal fittings are locked by the locking projections of the retainer to prevent removal from the corresponding cavities. The presence of the intermediate locking portion between the end locking portions on the retainer substantially prevents the retainer from warping in the middle, and therefore provides more secure locking of the terminals in the housing even if the housing is very wide.

According to a still further preferred embodiment, the connector includes at least one guide portion for guiding a connection of the housing and a mating housing. The guide portion preferably is provided on the front surface of the housing. Thus the guide portion preferably extends substantially between the adjacent cavities and along a connection direction of the housings. The intermediate locking portion preferably is provided behind the guide portion.

Further, the male and female housings can be connected smoothly with each other since the guide portion guides the connection of the housings. Further, since the intermediate receiving portion preferably is provided behind the guide portion, i.e. is located substantially on the same line as the guide portion with respect to the connection direction of the housing, the width of the housing needs not be increased even if the intermediate receiving portion is provided. Thus the housing can be kept small.

The locking portions preferably can be engaged with their corresponding receiving portions such that the retainer can be held in a partial locking position and a full locking position.

Most preferably, the intermediate locking portion is provided near the corresponding locking projection.

Accordingly, the intermediate locking portion provides a more effective locking of the locking projection for the corresponding terminal fitting.

These and other objects, features and advantages of the present invention will become more apparent upon a reading of the following detailed description and accompanying drawings.

DETAILED DESCRIPTION OF THE PREFERRED EMBODIMENT

Figure 1:
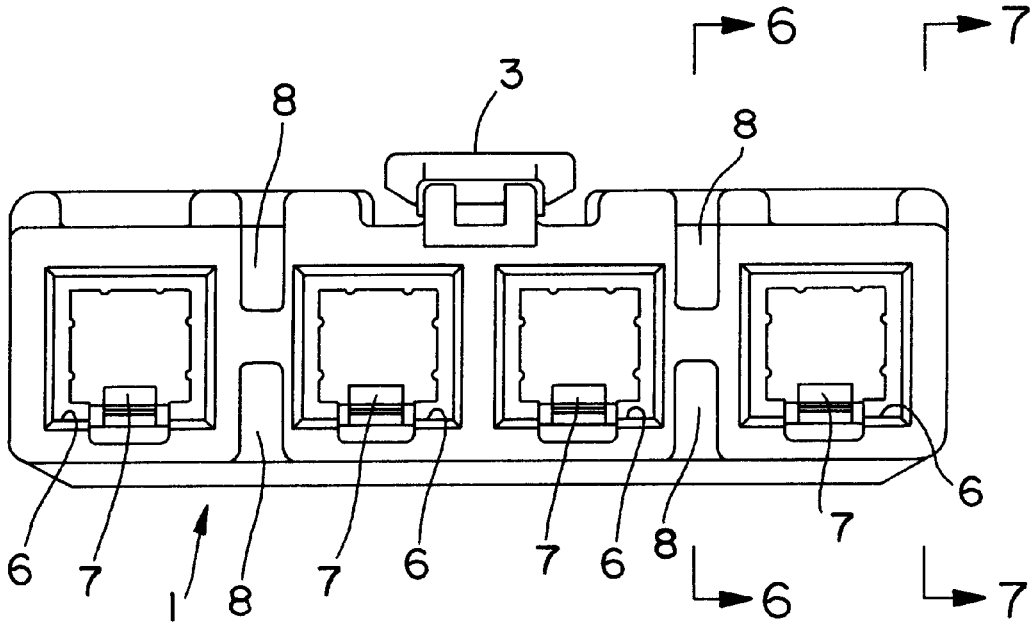
FIG. 1 is a front view of a housing.
Figure 2:
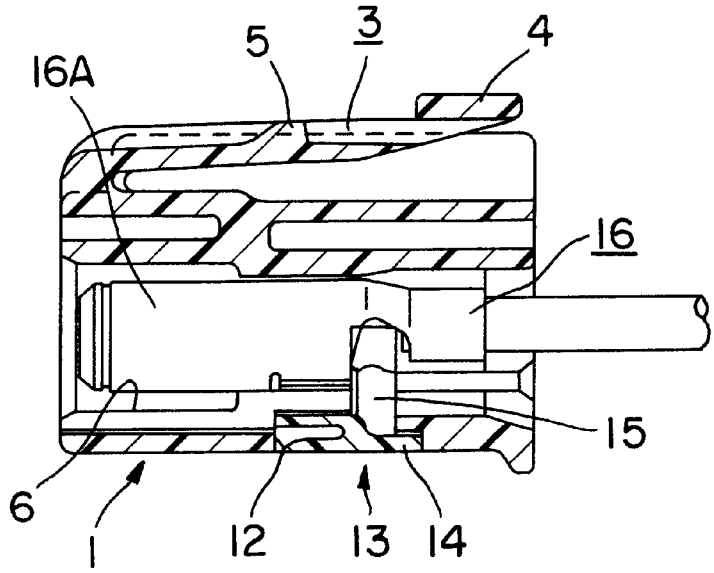
FIG. 2 is a section showing a state where a terminal is properly inserted.
Figure 3:
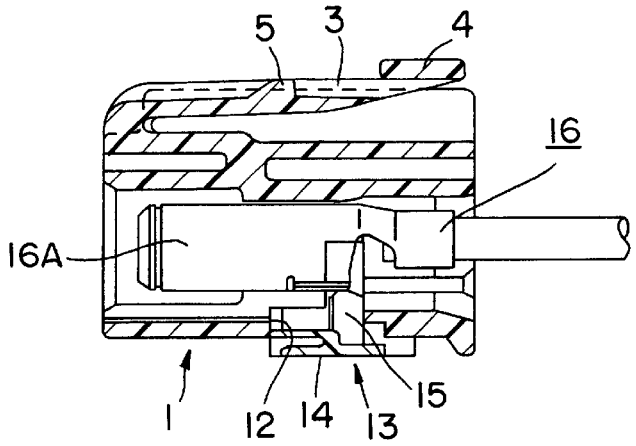
FIG. 3 is a section showing a state where the terminal fitting is insufficiently inserted.
Figure 16:
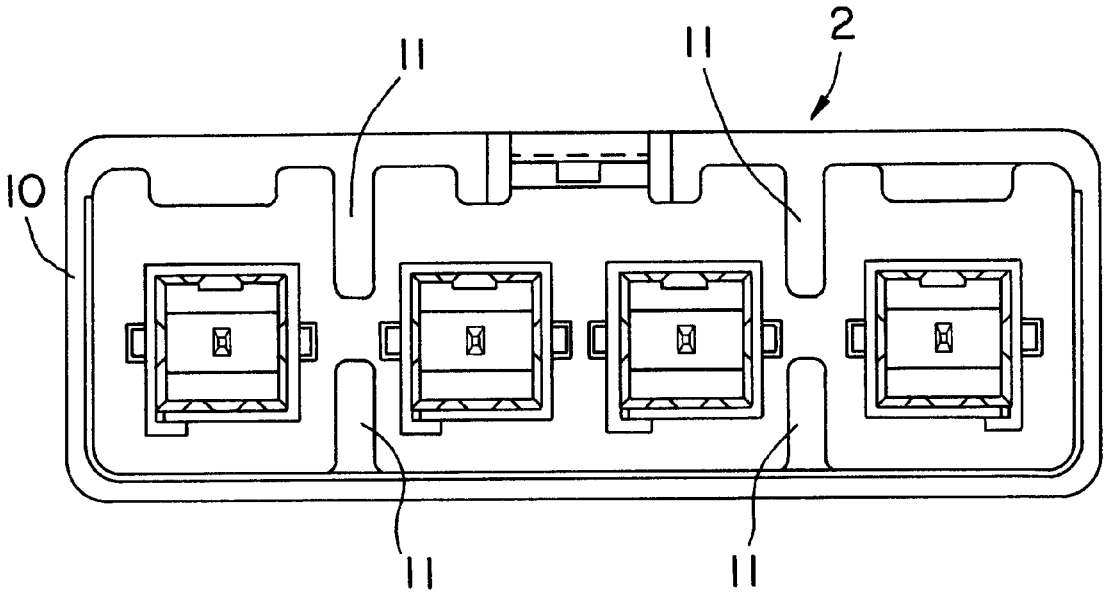
FIG. 16 is a front view of a male housing.

A connector in accordance with the invention includes a female housing 1 as shown in FIG. 1. The housing 1 is formed integrally or unitarily e.g. by a synthetic resin material. A lock arm 3 is provided on the upper surface of the female housing 1 for holding the female housing 1 and a mating male housing 2 (see FIG. 16) at least partly locked each other. The lock arm 3 cantilevers from the front end of the upper surface of the female housing 1, as shown in FIGS. 2 and 3, and is elastically deformable in a substantially vertical direction. An operating portion 4 is formed at the leading end of the lock arm 3 for disengaging the female housing 1 from the male housing 2, and a lock claw 5 is formed in an intermediate position thereof so as to be at least partly fit into an unillustrated lock recess of the male housing 2.

In this embodiment, four cavities 6 are formed preferably substantially side-by-side along a widthwise direction in the female housing 1. The respective cavities 6 penetrate through the female housing 1 along forward/backward directions, and can at least partly accommodate female terminal fittings 16 that are inserted preferably from behind. An elastically deformable locking portion 7 is provided in the middle of the bottom surface in each cavity 6 and is elastically engageable with the corresponding terminal fitting 16 to lock the respective terminal fitting 16 in the cavity 6.

Two grooves 8 are provided on the female housing 1 for guiding an engaging movement of the female housing 1 with the male housing 2. The grooves 8 are formed in walls that partition the cavities 6 located at the left and right ends of the female housing 1 from the adjacent cavities 6. Additionally, the grooves 8 extend substantially along the longitudinal direction of the female housing 1 and are spaced apart from each other along a widthwise direction. Partitioning walls 9 partition each groove 8 into an upper or first section and a lower or second section (see FIGS. 1 and 6).

The male housing 2 has a receptacle 10 into which the female housing 1 can be fit. Male terminal fittings are accommodated at least partly in the male housing 2. The male housing 2 further includes two pairs of vertically spaced ribs 11 that are provided between the male terminal fittings located at the opposite left and right sides of the male housing 2 and their adjacent male terminal fittings. The respective ribs 11 extend along the longitudinal direction (toward the back) of the male housing 2 from its engaging surface. These ribs 11 are fitted at least partly into the corresponding grooves 8 when the male and female housings 2, 1 are connected, thereby preventing the housings 1, 2 from being forcibly connected with each other.

A retainer mount hole 12 is formed in the bottom wall of the female housing 1 (see FIG. 4) for accommodating the retainer 13. The retainer mount hole 12 is open substantially over the entire width behind (at the rear side of) the grooves 8 in the bottom surface of the female housing 1, and communicates with the respective cavities 6. Further, as described in detail later, receiving portions 21, 22 for holding the retainer 13 in its partial and full locking positions are formed in a portion of the retainer mount hole 12.

Figure 8:
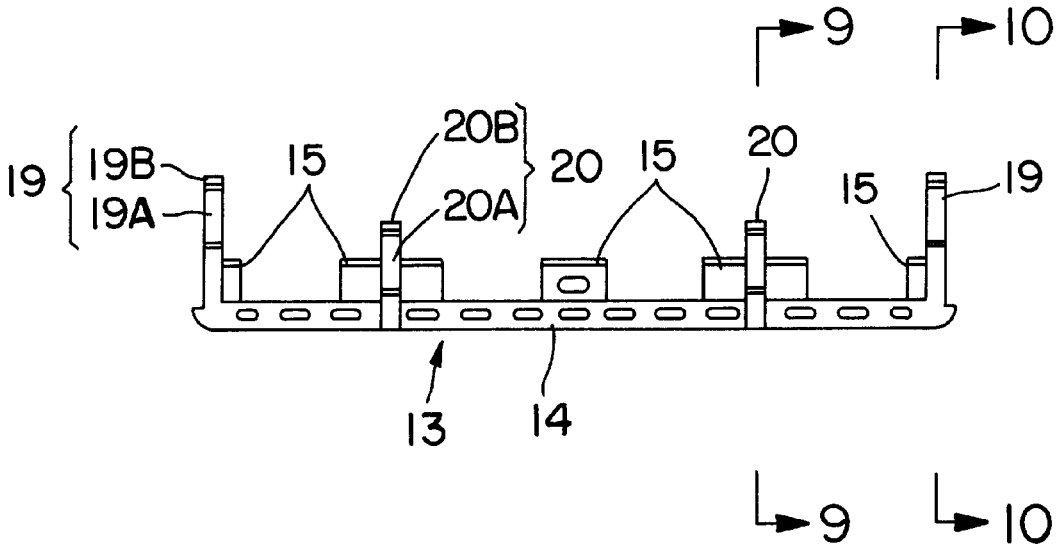
FIG. 8 is a front view of a retainer.

The retainer 13 also is made e.g. of a synthetic resin material similar to the female housing 1, and includes a planar base plate 14 that extends entirely across the retainer 13. A total of e.g. five locking projections 15 are formed at specified intervals along widthwise direction on the inner surface of a planar base plate 14, as shown most clearly in FIG. 8. The respective locking projections 15 are engageable with the rear ends of corresponding connection tubes 16A of the terminal fittings 16 when the respective terminal fittings 16 are inserted to their proper insertion positions, as shown in FIG. 2. Further, each female terminal fitting 16 preferably is locked by two adjacent locking projections 15 located at the opposite sides of the female terminal fitting 16. Thus, communication slits 18 are formed in partition walls 17 (excluding the outermost walls) for partitioning the adjacent cavities 6. The slits 18 have open bottom ends and communicate with the retainer mount hole 12. Accordingly, the respective locking projections 15 are at least partly fitted into the communication slits 18 when the retainer 13 is inserted into the retainer mount hole 12. Additionally, due to their positions at the opposite sides of the cavities 6, the locking projections 15 engage the left and right sides of the rear ends of the connection tubes 16A of the adjacent female terminal fittings 16. The second locking projections 15 from the left and right ends in FIG. 8 are wider than the others because these wider locking projections 15 correspond to the cavities 6 on the opposite sides of the above-mentioned grooves 8.

Figure 9:
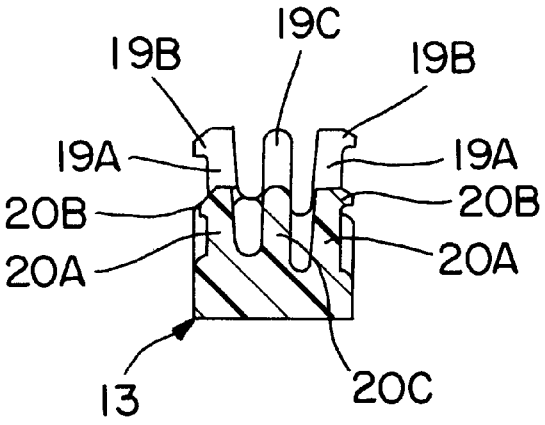
FIG. 9 is a section along line 9—9 of FIG. 8.
Figure 10:
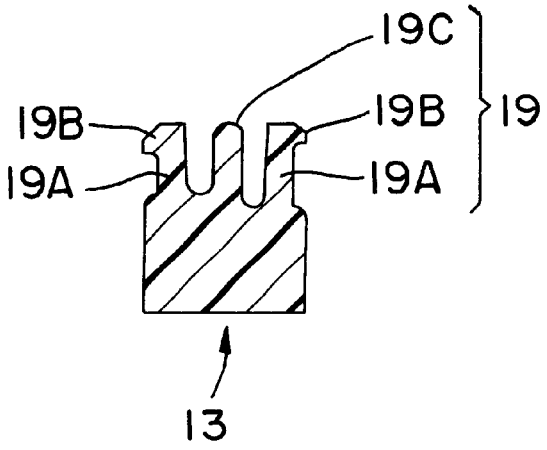
FIG. 10 is a section along line 10—10 of FIG. 8.
Figure 11:
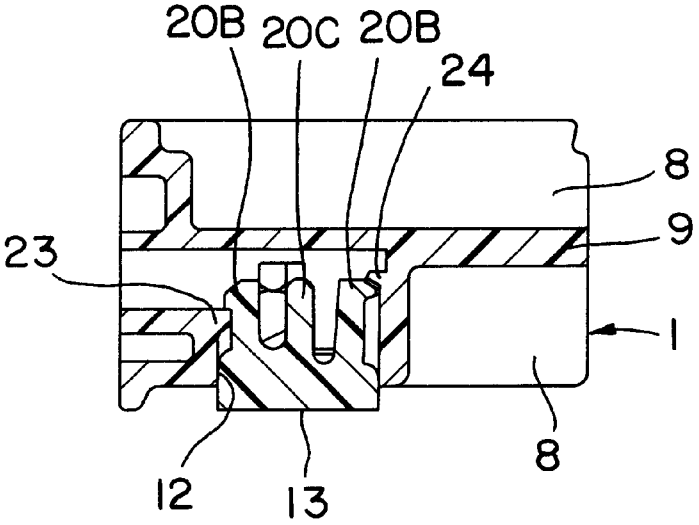
FIG. 11 is a section showing a partial locking state of an intermediate locking portion and an intermediate receiving portion.
Figure 12:
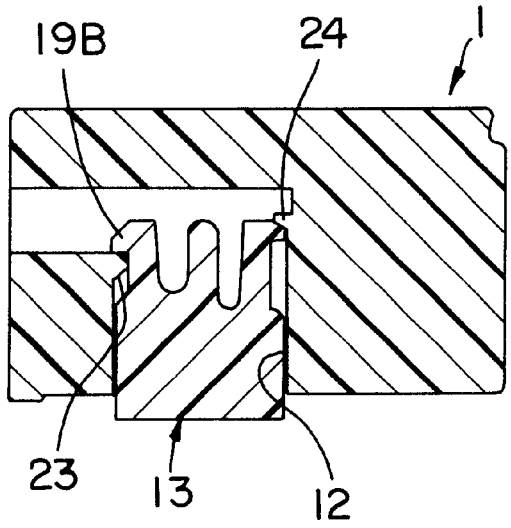
FIG. 12 is a section showing a partial locking state of an end-locking portion and an end-receiving portion.
Figure 13:
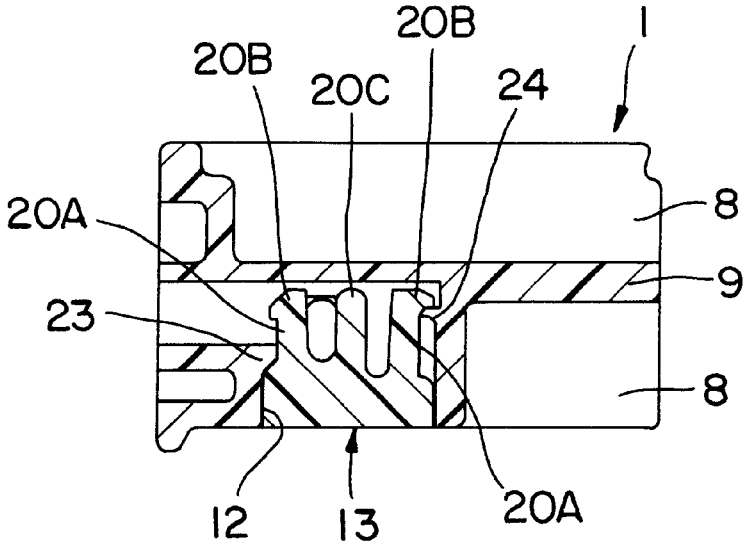
FIG. 13 is a section showing a full locking state of the intermediate locking portion and the intermediate receiving portion.
Figure 14:
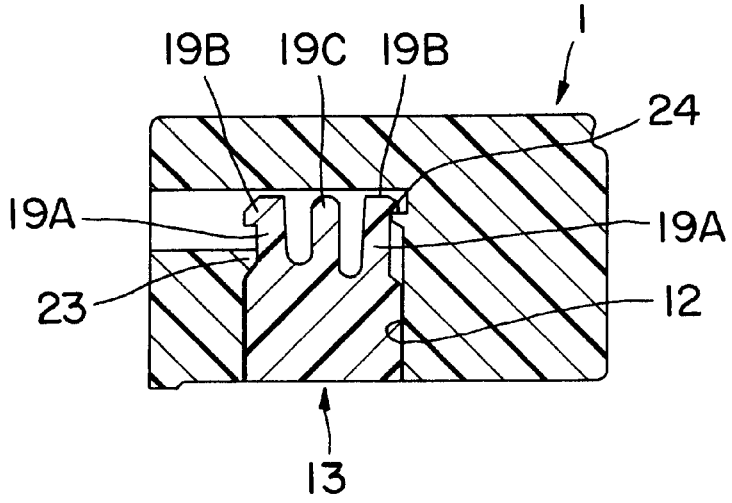
FIG. 14 is a section showing the full locking state of the end-locking portion and the end-receiving portion.
Figure 15:
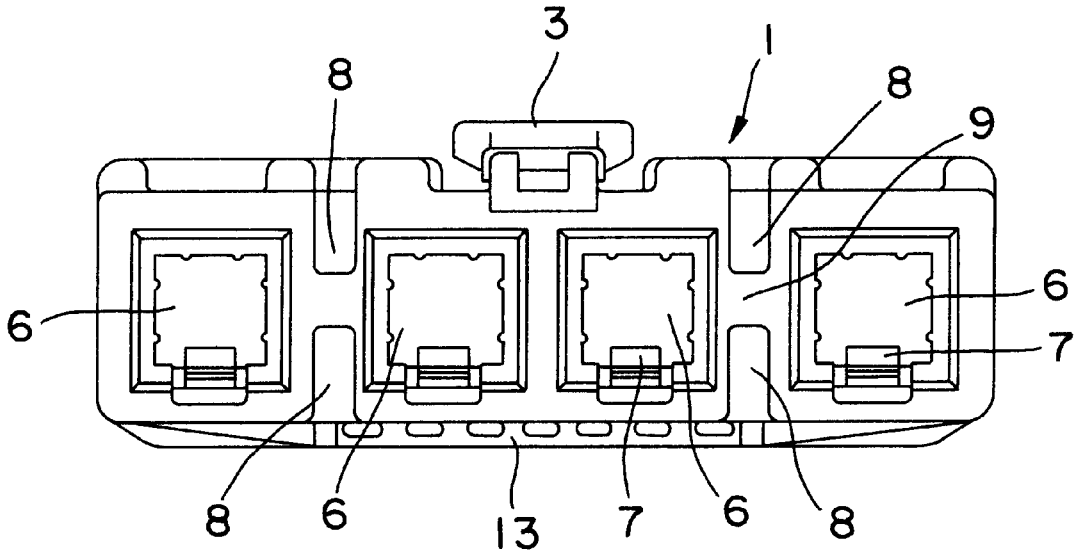
FIG. 15 is a front view showing a state where the retainer is warped due to an insufficient insertion of the terminal fitting.

Two end-locking portions 19 are provided on the inner surface of the retainer 13 and at the opposite ends of the planar base plate 14. Additionally, two intermediate locking portions 20 are provided between the end locking portions 19. Thus the intermediate locking portions are provided in an intermediate position on the retainer 13 in a widthwise direction. As shown in FIG. 9, the end locking portions 19 and the intermediate locking portions 20 have similar basic constructions, but have different heights. The end and intermediate locking portions 19, 20 are comprised of elastically deformable legs 19A, 20A of substantially the same height which are provided at the front and rear sides. Claws 19B, 20B are formed at the outer surfaces of the leading ends of the legs 19A, 20A. Projections 19C, 20C have substantially the same height as the legs 19A, 20A and are provided between the legs 19A and between the legs 20A, respectively.

Figure 4:
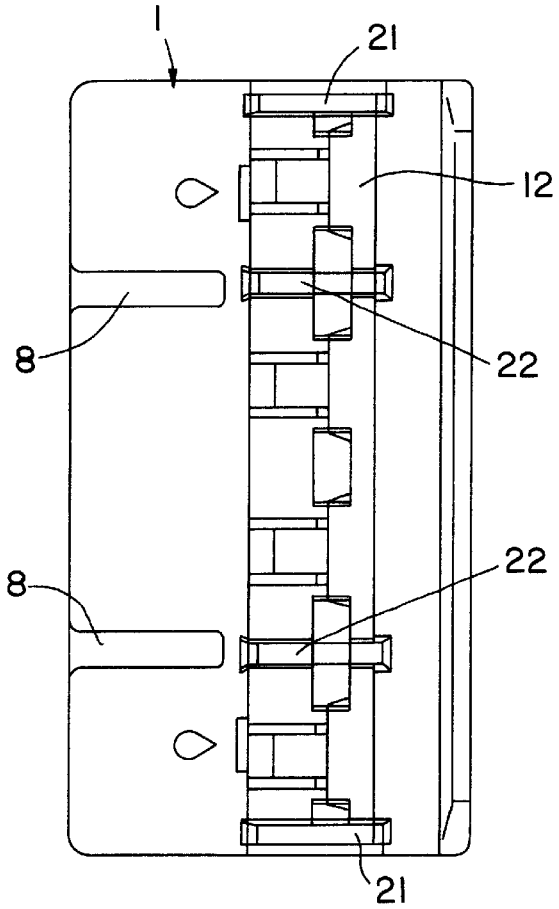
FIG. 4 is a bottom view of the housing.
Figure 5:
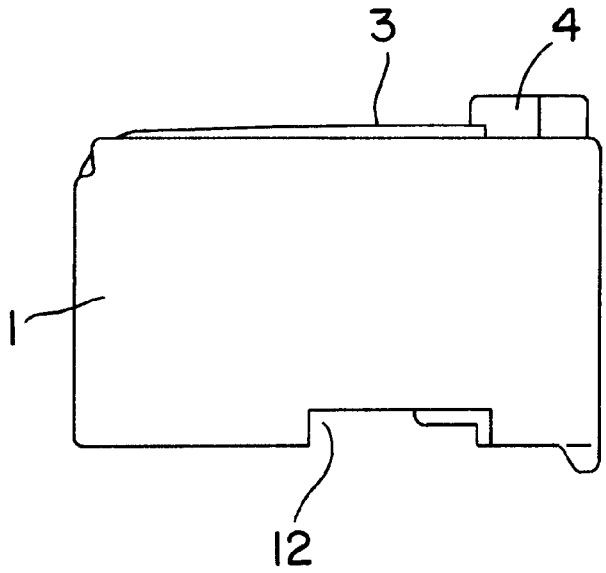
FIG. 5 is a side view of the housing.
Figure 7:
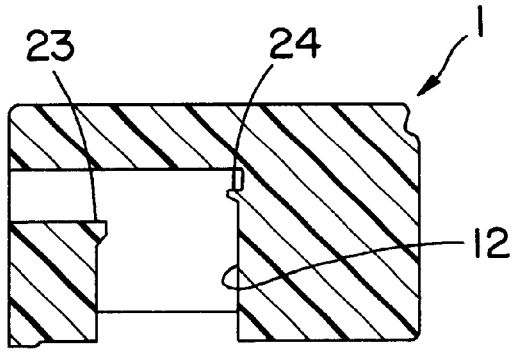
FIG. 7 is a section along line 7—7 of FIG. 1.

The female housing 1 is provided with receiving portions 21, 22 corresponding to the respective locking portions 19, 20. More specifically, the end receiving portions 21 are formed in positions near the left and right ends inside the retainer mount hole 12 as shown in FIG. 4, and thus are provided for receiving the end locking portions 19. As shown in FIG. 7, wall surfaces are defined in each receiving portion 21, and are substantially opposed to each other along forward/backward directions. A partial locking projection 23 and a full locking projection 24 project from the respective wall surfaces at different levels. These projections 23, 24 can be engaged and disengaged selectively with the claws 19B of the legs 19A of the end locking portions 19. When the retainer 13 is located in its partial locking position in the female housing 1, the left locking projections 23 in FIG. 7 are engaged with their corresponding claws 19B of the legs 19A. When the retainer 13 is pushed further, i.e. moved to its full locking position, the right locking projections 24 of FIG. 7 are engaged with their corresponding claws 19B of the legs 19A. When the retainer 13 is in its partial locking position, the withdrawal and insertion of the female terminal fittings 16 are permitted since the respective locking projections 15 and the female terminal fittings 16 do not interfere with each other. However, when the retainer 13 is in its full locking position, the respective locking projections 15 are engaged with the rear ends of the connection tubes 16A of the female terminal fittings 16, thereby locking the female terminal fittings 16 so as not to come out.

Figure 6:
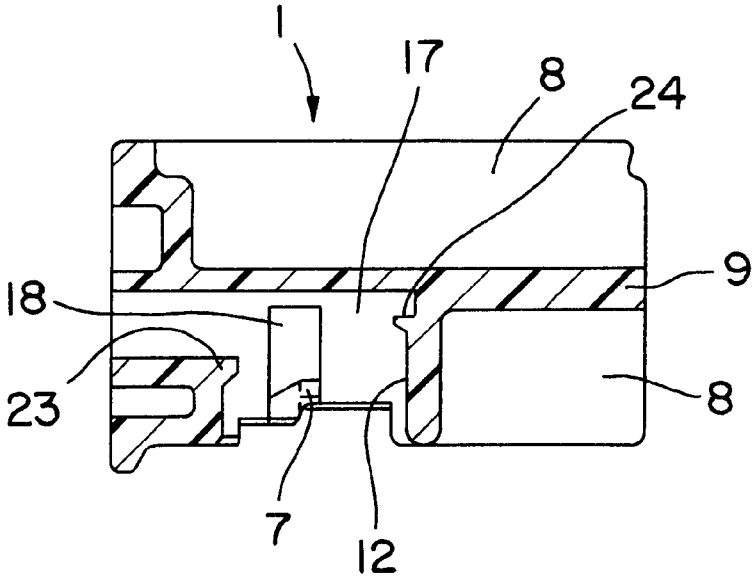
FIG. 6 is a section along line 6—6 of FIG. 1.

The intermediate receiving portions 22 are provided behind the grooves 8 in the retainer mount hole 12 (see FIGS. 4 and 6). Similar to the end receiving portions 21, the partial and full locking projections 23, 24 are formed on the opposing wall surfaces in the intermediate receiving portions 22. These locking projections 23, 24 can be engaged and disengaged selectively with the legs 20A of the intermediate locking portions 20 at the partial and full locking positions.

The connector of this embodiment is assembled and used as described below. First, the retainer 13 is aligned with and slightly pushed into the retainer mount hole 12 of the female housing 1. Then, the claws of the respective legs of the end and intermediate locking portions 19, 20 are engaged with the partial locking projections 23 of the end and intermediate receiving portions 21, 22.

Thereupon, the retainer 13 is held in its partial locking position in the female housing 1.

Subsequently, the female terminal fittings 16 are inserted to their proper insertion positions in the respective cavities 6 of the female housing 1, and are first locked by the locking portions 7. The retainer 13 then is pushed further into the retainer mount hole 12. Thus, the claws 19B, 20B of the legs 19A, 20A are disengaged from the partial locking projections 23, and the claws 19B, 20B of the legs 19A, 20A at the opposite side come into engagement with the full locking projections 24. In this way, the retainer 13 is held in its full locking position. Since the respective locking projections 15 of the retainer 13 are engaged with the rear ends of the connection tubes 16A of the female terminal fittings 16 in the full locking position, the locking portions 7 and the locking projections 15 cooperate to achieve a redundant and more secure locking of the female terminal fittings 16.

In this embodiment, the retainer 13 is provided with the two locking portions in positions near the center in addition to those at the opposite ends. In the prior art connector, the terminal fittings may be locked with a reduced force at the center portion due to an insufficient rigidity resulting from an increased width of the retainer. However, since the locking portions are provided even at the center portion in this embodiment, the terminal fittings located at the center portion can be locked with a sufficient force.

Further, if the female terminal fitting 16 is inserted insufficiently into any one of the cavities 6 located, for example, at or near the center, the corresponding locking projection 15 comes into contact with the outer surface of the connection tube 16A of the female terminal fitting 16, thereby making any further pushing impossible. Since the locking portions are provided only at the opposite ends in the prior art connector, an operator may mistakenly confirm the proper insertion of the terminal fitting because the opposite ends are locked although a center portion of the retainer bulges up. However, since the locking portions are provided also at or near the center in this embodiment, i.e. portions which require pushing are newly added, the insufficient insertion can be securely known by noticing that the intermediate locking portion 20 located near a position where the terminal fitting is insufficiently inserted is not locked.

In addition, since the intermediate receiving portions 22 are provided behind the already existing construction for preventing the male and female housings 2, 1 from being forcibly connected with each other in this embodiment, the width of the female housing 1 is not increased despite an addition of a new construction, thereby contributing to keeping the housing small.

A variety of changes can be made in the present invention, and the following modifications also are embraced by the technical scope of the present invention as defined in the claims. The numbers of the cavities 6, the intermediate locking portions 20 and the intermediate receiving portions are not limited to those described in the foregoing embodiment. They should be suitable changed according to the specification of a connector. Additionally, the present invention is applicable not only to female connectors, but also to male connectors.

What is claimed is:

1. A connector, comprising:

a housing having a plurality of cavities and a retainer mount hole communicating with each said cavity;

terminal fittings at least partly accommodated in the respective cavities;

an elongate retainer mountable in the retainer mount hole, the retainer comprising at least one locking projection projecting transversely from the retainer for locking the terminal fittings and preventing the terminal fittings from coming out when each terminal fitting is inserted to a proper position in the respective cavity;

wherein at least one intermediate locking portion is provided in an intermediate position of the retainer, and at least one intermediate receiving portion is provided in a position on the housing corresponding to the position of the intermediate locking portion the intermediate locking portion being engageable with the intermediate receiving portion when the retainer is inserted to a proper position in the retainer mount hole for holding the retainer in the housing; and end locking portions provided at the opposite ends of the retainer, and end receiving portions provided in the housing and being engageable with the end locking portions when the retainer is inserted to a proper position in the retainer mount hole for holding the retainer in the housing, the at least one intermediate locking portion being provided between the end locking portions, said intermediate locking portion and said end locking portions each extending transversely from said retainer, said end locking portions extending a greater distance than the intermediate locking portion.

2. A connector according to claim 1, wherein the retainer mount hole is open in one side surface of the housing.

3. A connector according to claim 1, further comprising at least one guide portion for guiding a connection of the housing and a mating housing, the intermediate receiving portion being provided behind the guide portion.

4. A connector according to claim 1, wherein the locking portions are engageable with their corresponding receiving portions such that the retainer can be held in a partial locking position and a full locking position.

5. A connector according to claim 1, wherein the at least one intermediate locking portion is provided in the vicinity of the corresponding locking projection.

6. A connector, comprising:

a housing having at least one cavity and a retainer mount hole;

at least one terminal fitting at least partly accommodated in the cavity;

a retainer mountable in the retainer mount hole, the retainer comprising at least one locking projection for locking the terminal fitting and preventing the terminal fitting from coming out when the terminal fitting is inserted to a proper position in the cavity;

at least one intermediate locking portion in an intermediate position of the retainer, and at least one intermediate receiving portion in a position on the housing corresponding to at least one guide portion for guiding a connection of the housing and a mating housing, the intermediate receiving portion being provided behind the guide portion; and wherein the at least one cavity comprises a plurality of cavities, and wherein the at least one guide portion is provided at a front surface of the housing, such that the guide portion substantially extends between adjacent ones of the cavities and along a connection direction of the housings.

7. A connector, comprising:

a housing having opposed front and rear ends, top and bottom walls in spaced relationship to one another and extending between the opposed front and rear ends, side walls connecting the opposed top and bottom walls and extending between the front and rear ends, a plurality of cavities disposed in side-by-side relationship between the side walls of the housing and extending from the front end to the rear end, an elongated retainer mount hole extending through the bottom wall of the housing and communicating with each of said cavities;

a plurality of terminal fittings at least partly accommodated respectively in the cavities;

an elongated retainer mountable in the elongated retainer mount hole, the elongated retainer comprising at least one locking projection for locking the terminal fittings and preventing the terminal fittings from coming out of the respective cavities when the terminal fittings are inserted to a proper position in the respective cavities;

first and second end locking portions extending transversely from a side of the elongate retainer substantially at opposite ends of the elongated retainer;

first and second end receiving portions provided in the housing in proximity to the side walls thereof and being engageable with the end locking portions when the retainer is inserted to a proper position in the retainer mount hole for holding the retainer in the housing; and at least one intermediate locking portion extending transversely from the side of the elongated retainer at a location between the end locking portions; and at least one intermediate receiving portion in a position on the housing corresponding to the position of the intermediate locking portion for locking the retainer at an intermediate position, holding the retainer in the housing and preventing deformation of the retainer between the end locking portions, wherein the end locking portions project transversely further distances relative to the retainer than the intermediate locking portion.

* * * * *